US005480592A

United States Patent [19]

Morrow

[11] Patent Number: 5,480,592

[45] Date of Patent: Jan. 2, 1996

[54] SIDE DRAFT CARBURETOR FOR MOTORCYCLES

[76] Inventor: Carl D. Morrow, 9339 Santa Fe Springs Rd., Santa Fe Springs, Calif. 90670

[21] Appl. No.: 399,033

[22] Filed: Mar. 6, 1995

[51] Int. Cl.[6] ..... F02M 9/06

[52] U.S. Cl. ..... 261/44.4

[58] Field of Search ..... 261/44.4, 44.3

[56] References Cited

U.S. PATENT DOCUMENTS

| | | | |
|---|---|---|---|
| 3,765,658 | 10/1973 | Hartel et al. | 261/44.4 |
| 4,264,537 | 4/1981 | Watanabe et al. | 261/44.4 |
| 4,484,557 | 11/1984 | Matsubara | 261/44.4 |
| 4,500,477 | 2/1985 | Zaita et al. | 261/44.3 |

*Primary Examiner*—Tim R. Miles
*Attorney, Agent, or Firm*—Edgar W. Averill, Jr.

[57] ABSTRACT

A side draft carburetor for motorcycles. The carburetor has a body with a horizontal airflow passageway, the airflow through which is controlled by a butterfly valve near the exit side of the carburetor. An upper cylinder is vertically positioned over the airflow passageway and has a large inside diameter portion and a smaller inside diameter portion. A piston member is vertically moveable in the upper cylinder and has an upper piston portion which is fitted in an airtight manner but freely moveable in the upper cylinder and a lower piston member is closely fitted in the lower cylinder. An airflow passageway to the outside of the carburetor body is provided at the base of the upper cylinder. The piston member is closed at the bottom except for an airflow passageway. A tapered needle is held by the piston member and extends downwardly into a jet assembly held in a jet holding member. As air is pulled through the carburetor, the resulting reduced pressure causes the piston member to move upwardly, thereby raising the needle and allowing more fuel to flow in around the needle into the airflow passageway. The piston is light in weight and has only a spring to control its vertical movement in the cylinder. The jet assembly is provided with an adjustment so it can be moved upwardly and downwardly to a preferred level.

9 Claims, 3 Drawing Sheets

SIDE DRAFT CARBURETOR FOR MOTORCYCLES

BACKGROUND OF THE INVENTION

The field of the invention is carburetors and the invention relates more particularly to side draft carburetors. Carburetors having a vacuum controlled piston holding a needle have been known for many years and are generally referred to as "SU" carburetors. Such carburetors were typically provided with a fluid damping means to dampen the movement of the piston. They are also provided with a diaphragm held jet assembly and are designed to be used with a fuel pump supplying gasoline under some positive pressure.

The SU design has not proved successful in motorcycles. This is because a motorcycle engine does not provide the amount of engine vacuum to operate the carburetor. Also motorcycle engines do not use a fuel pump and instead rely only on a gravity feed.

BRIEF SUMMARY OF THE INVENTION

It is an object of the present invention to provide a side draft carburetor useful for motorcycle engines. The present invention is for a side draft carburetor having a carburetor body with an inlet side and an exit side, a top and a bottom, and an airflow passageway positioned horizontally therethrough. A butterfly valve is positioned in the airflow passageway near the exit side of the carburetor body. An upper cylinder has a vertical central axis and a large diameter. The upper cylinder is closed at the top and a lower cylinder is coaxially positioned below the upper cylinder. The lower cylinder has a smaller inside diameter than the upper cylinder and the lower cylinder opens into the airflow passageway so that its central axis intersects the central axis of the airflow passageway. A piston member has an upper piston portion which fits, in an airtight manner, in the upper cylinder and a lower piston portion which fits closely in the lower cylinder. The upper piston is open at the top and the lower piston is closed at the bottom except for an air passageway leading into the airflow passageway. The piston is vertically moveable and has a tapered needle extending downwardly therefrom. A jet holding member is held in the lower cylinder below the airflow passageway and the jet holding member has a central passageway including an annular fuel flow ring. The jet holding member is sealed to the lower cylinder by o-rings above and below the annular fuel flow ring. Means are provided for passing fuel into the annular fuel flow ring. A jet assembly is sealingly held in the central passageway of the jet holding member. The jet assembly has a small vertical cylindrical passageway closed at the bottom and having a fuel passageway which leads from the annular fuel flow ring. The tapered needle moves upwardly and downwardly in the vertical central passageway. The jet assembly is vertically adjustable. The piston, thus, rises as air is pulled through the carburetor and a larger flow rate of fuel is permitted since the needle is pulled partially out of the central passageway of the jet assembly. Preferably the jet assembly is urged downwardly by a spring and an adjustment screw extends outwardly from the bottom of the carburetor to position the jet assembly in a desired position. Preferably the jet assembly has an o-ring seal above and below the fuel passageway which retains the fuel over just a portion of the jet assembly while still permitting the jet assembly to be moved upwardly and downwardly for adjustment purposes. Preferably the top of the carburetor is sealed by a screw cap and the piston is urged downwardly by a spring.

DESCRIPTION OF THE PREFERRED EMBODIMENTS

Figure 1:
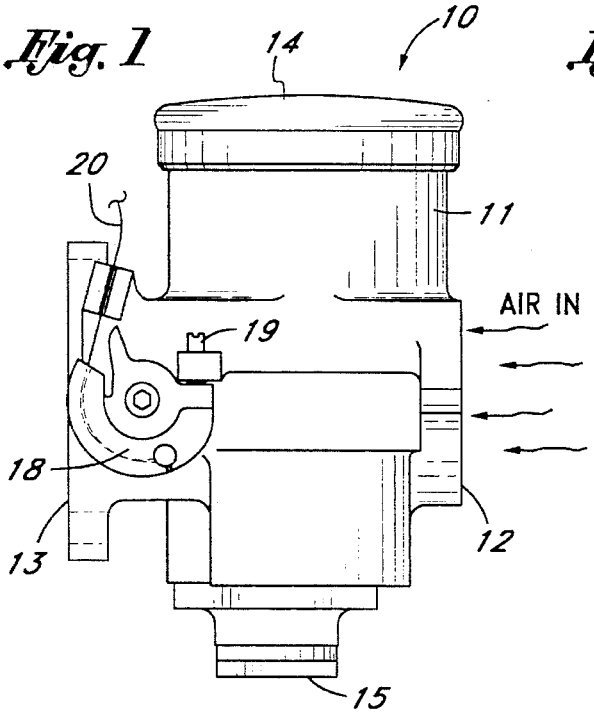
FIG. 1 is a front view of the carburetor of the present invention showing an air inlet on the right side.

The carburetor of the present invention is shown in FIG. 1 and indicated generally by reference character 10. Carburetor 10 has a body 11 which has an inlet side 12, an exit side 13, a top 14 and a bottom 15. An airflow passageway shown best in FIG. 5 of the drawings is indicated by reference character 16. A butterfly valve 17 is adjustable by turning in a conventional manner that is controlled by the throttle actuator arm 18 shown best in FIG. 1. Throttle stop screw 19 provides idle adjustment and the butterfly valve is controlled by moving cable 20.

Figure 2:
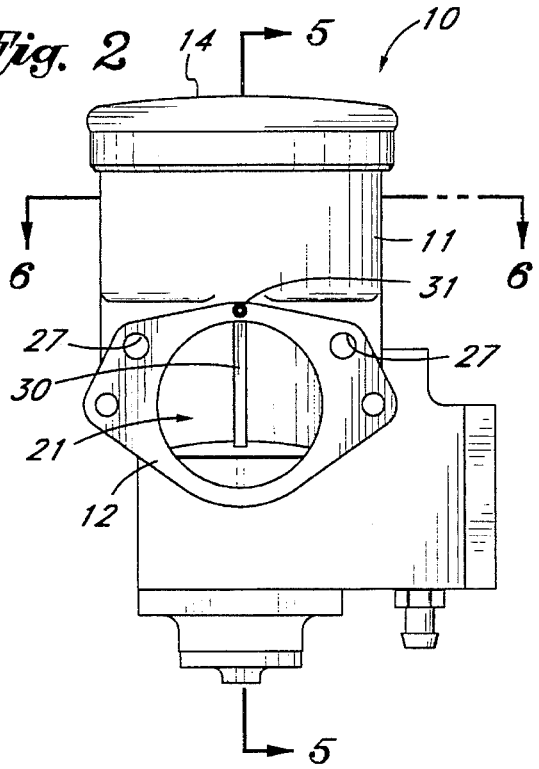
FIG. 2 is a left side view thereof.
Figure 3:
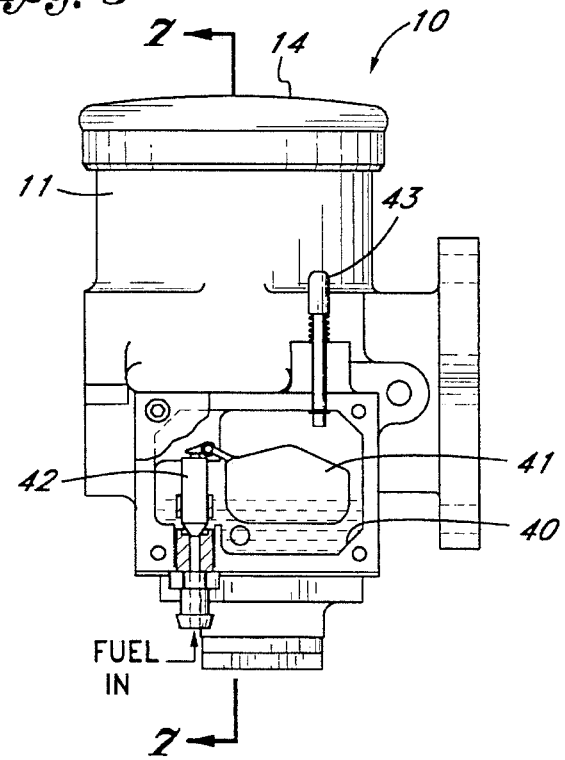
FIG. 3 is a rear view thereof.
Figure 4:
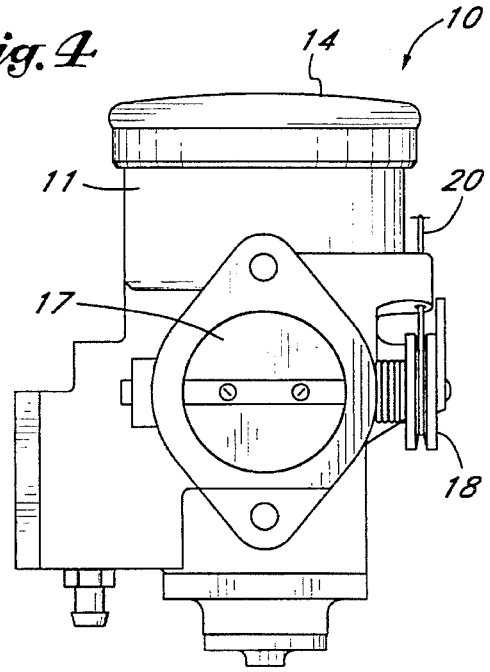
FIG. 4 is a right side view thereof.
Figure 7:
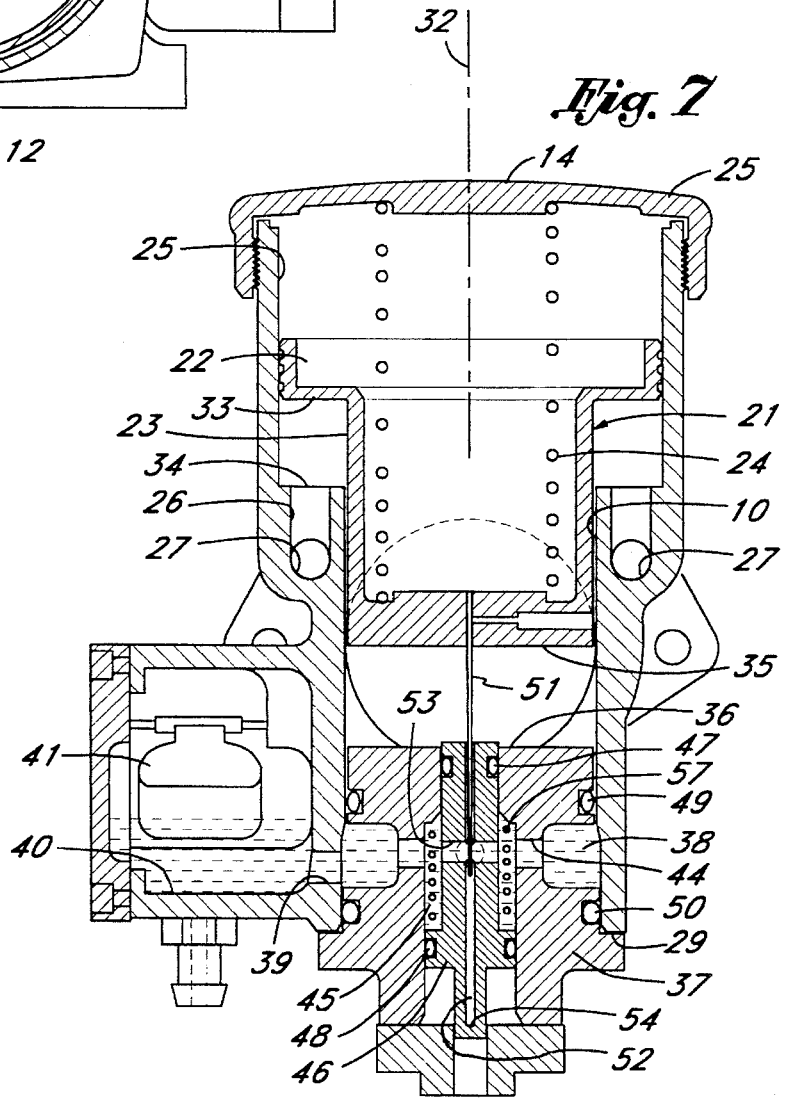
FIG. 7 is an enlarged cross-sectional view taken along line 7—7 of FIG. 3.

Turning now to FIG. 7, the fuel flow of the carburetor is most clearly shown. A light piston 21 has an upper piston portion 22 and a lower piston portion 23. A spring 24 urges the piston downwardly and abuts screw cap 25. Upper piston 22 abuts the inside diameter of upper cylinder 25 in an airtight but moveable manner. A vent 26 permits air to flow to the outside of the carburetor body and is indicated in FIG. 2 by reference character 27.

A lower smaller cylinder 28 extends to the base 29 of carburetor 20 and supports lower piston 23. Lower piston 23 is prevented from turning by a groove 30 formed vertically therein and a guide screw 31.

Piston member 21 is vertically moveable along a vertical axis 32. When there is no air movement the piston moves downwardly until the lower step 33 abuts ledge 34. At this point the bottom 35 is slightly above the top 36 of jet holding member 37. Jet holding member 37 is secured by screws to the base 29 of carburetor body 11.

Fuel is supplied to an annular fuel flow ring 38 through an opening 39 in a fuel holding bowl 40. Fuel holding bowl 40 includes a float 41 which controls an inlet fuel valve 42. The float may be manually depressed by depressing pin 43 which permits the fuel level in bowl 40 to rise.

Returning now to FIG. 7, the fuel passes from annular flow ring 38 through a series of passageways 44 into a central passageway 45 surrounding jet assembly 46. Jet assembly 46 has an upper o-ring groove and o-ring 47 and a lower o-ring groove and o-ring 48. Similarly, jet holding member 37 has an upper o-ring groove and o-ring 49 and a lower o-ring groove and o-ring 50 which safely seal the fuel in the annular fuel flow ring 38 and the central passageway 45 except for that fuel which passes upwardly around tapered needle 51. Tapered needle 51 is held by the bottom 35 of piston 28. The fuel is permitted to flow into a vertical cylindrical passageway or orifice 52 through openings 53.

Vertical central passageway 52 is closed at the bottom 54. It can be seen that as tapered needle 51 rises a greater amount of fuel will be sucked into airflow passageway 16 by the passage of air being pulled past butterfly valve 17. The piston member 21 is caused to rise by air being pulled through air passageway 55 shown in FIG. 5. This reduces the pressure in volume 56 which thereby pulls the piston member 21 upwardly allowing more air to flow through raising the needle as shown in FIG. 5 and permitting more fuel to be mixed into the airflow.

Figure 5:
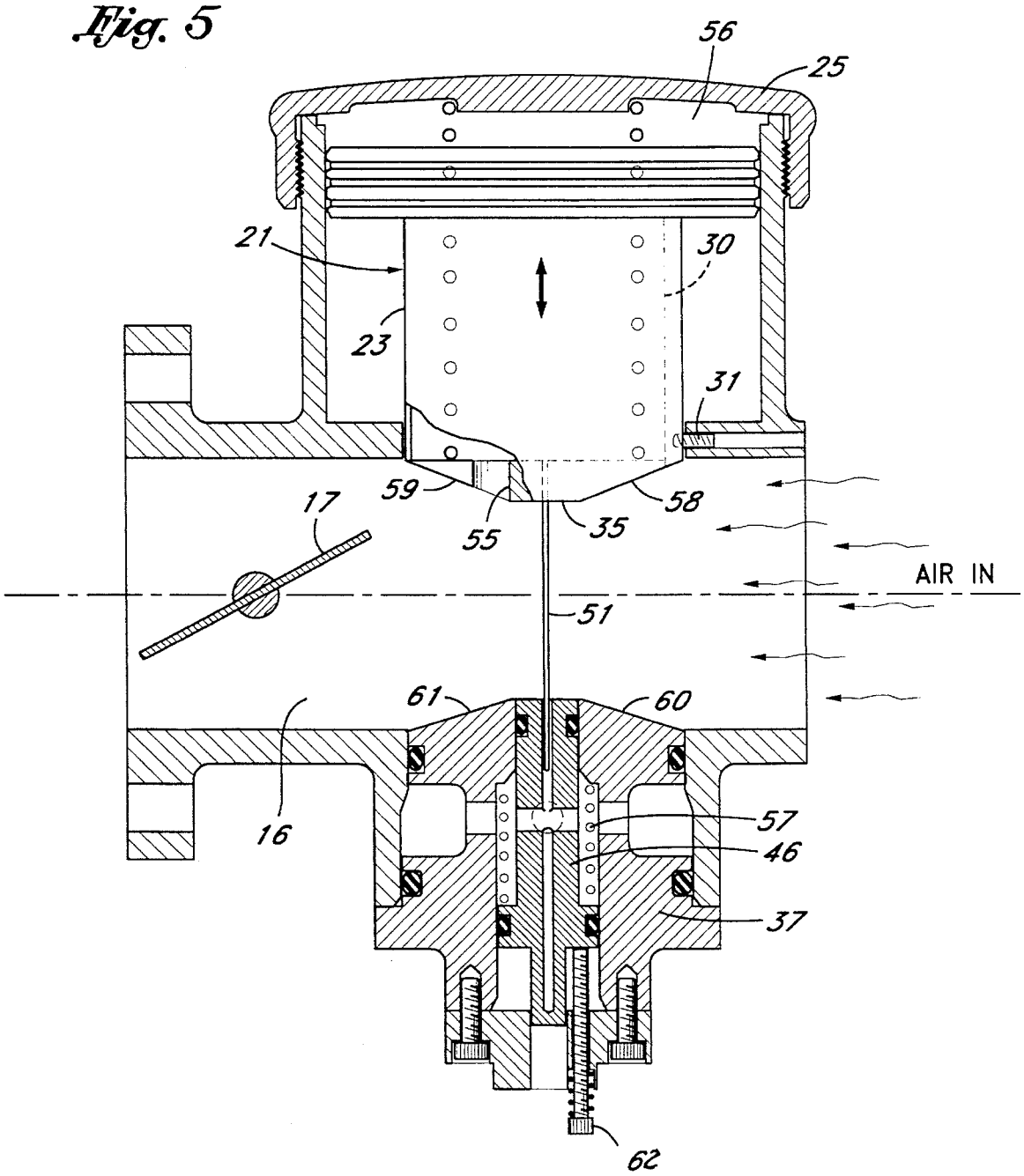
FIG. 5 is an enlarged cross-sectional view taken along line 5—5 of FIG. 2.
Figure 6:
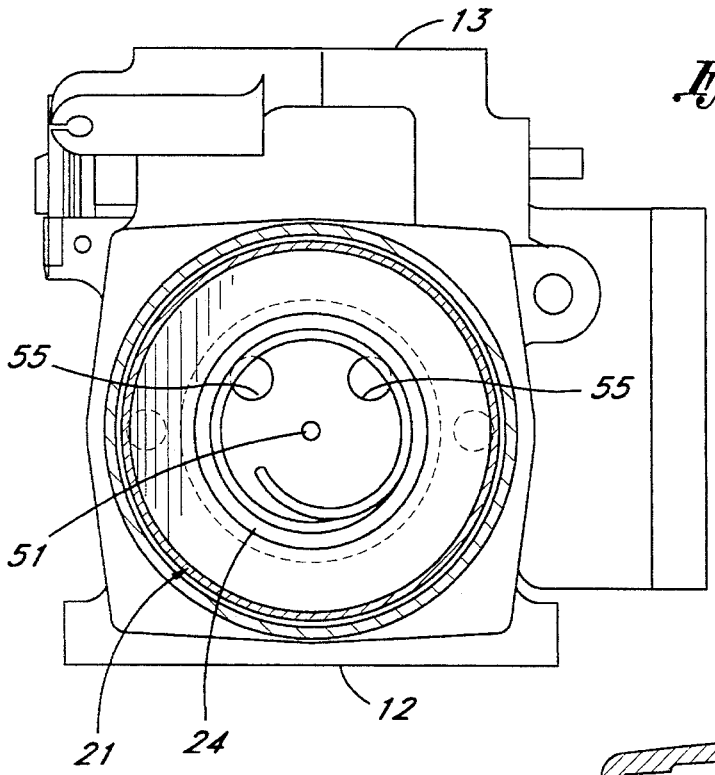
FIG. 6 is an enlarged cross-sectional view taken along line 6—6 of FIG. 2.

As also shown in FIG. 5 a jet position adjustment screw 62 pushes the main jet assembly 46 upwardly. Jet assembly 46 is urged downwardly by spring 57 and thus, as jet position adjustment screw is loosened, jet assembly 46 moves downwardly.

Preferably the bottom 35 of lower piston 23 is beveled as shown at reference characters 58 on the inlet side and 59 on the outlet side. Similarly, jet holding member 37 is tapered at 60 on the air inlet side and 61 on the air outlet side. This directs the flow of air and reduces turbulence as air flows through the carburetor.

If it is desired to change the needle size or otherwise disassemble the carburetor, the screw cap 25 may be easily removed thereby permitting piston member 21 to be removed together with tapered needle 51.

The resulting carburetor has a minimum number of parts and yet is highly responsive in use. The carburetor has only two adjustments. The idle is adjusted by the throttle stop screw 19. Full range intermediate and top range jetting is accomplished by raising and lowering the main jet assembly 46 which raises and lowers the main jet orifice 52. Since the main jet assembly is spring loaded, it is easily raised and lowered by turning adjustment screw 62.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A side draft carburetor for motorcycles comprising:

a carburetor body having an inlet side, an exit side, a top and a bottom, an air flow passageway having a horizontal central axis passing from the inlet side to the exit side and a butterfly valve near the exit side within said air flow passageway;

an upper cylinder having a vertical axis and having a large inside diameter and a closable top and a lower cylinder positioned below said upper cylinder having a smaller inside diameter, said lower cylinder intersecting said air flow passageway so that its central axis intersects said horizontal central axis and said lower cylinder extending below said air flow passageway;

a piston member having an upper piston is held in an air tight but freely vertically movable manner in the upper cylinder and a lower piston closely fitted in the lower cylinder, said upper piston being open at the top and said lower piston being closed at the bottom except for air passageway means through said closed bottom and said piston member being vertically movable so that the lower piston blocks most of said air flow passageway when said piston is in its lowermost position and is above most of said air flow passageway when in its uppermost position, said upper large upper cylinder being vented to an exterior of said carburetor body so that said piston member may freely move up and down and a spring positioned between said upper piston and said closable top and means for preventing said piston member from turning in the upper or lower cylinder;

a tapered needle axially held by said lower piston extending downwardly therefrom;

a jet holding member held in said lower cylinder below said air flow passageway, said jet holding member having a central passageway and an annular fuel flow ring, said jet holding member being sealed to said lower cylinder by O-rings above and below said annular fuel flow ring;

means for passing fuel into said annular fuel flow ring; and a jet assembly sealingly held in said central passageway of said jet holding member, said jet assembly having a vertical cylindrical passageway closed at the bottom and having a fuel passageway to said annular fuel flow ring and said tapered needle being movably positioned in said vertical cylindrical passageway, said tapered needle moving up and down as said piston member moves up and down and said jet assembly being vertically adjustable whereby when any air is pulled through said air flow passageway, the air pressure in said air flow passageway decreases causing the piston and needle to rise by the reduced pressure above the upper piston permitting more fuel to be mixed in said air passing through said air flow passageway.

2. The side draft carburetor of claim 1 wherein said jet assembly is biased downwardly and an adjustment screw is held by the bottom of said carburetor body and abuts the jet assembly and urges it upwardly when turned in a first direction and downwardly when turned in an opposite direction.

3. The side draft carburetor of claim 2 wherein said jet assembly has an O-ring slot and an O-ring positioned both above and below said fuel passageway of said jet assembly thereby sealing a fuel flow path from the exterior to the vertical cylindrical passageway.

4. The side draft carburetor of claim 1 wherein said closable top is a cap which is screwed onto the top of said upper cylinder.

5. The side draft carburetor of claim 1 wherein the bottom of said lower piston is tapered at an air inlet side.

6. The side draft carburetor of claim 5 wherein the bottom of said lower piston is tapered on an air outlet side.

7. The side draft carburetor of claim 6 wherein said air passageway means through the bottom of said lower piston is located through a tapered side of said bottom of said lower piston.

8. The side draft carburetor of claim 7 wherein said jet holding member has a tapered top which extends into said air flow passageway.

9. The side draft carburetor of claim 1 wherein said carburetor further includes a fuel bowl and float controlling fuel flow into said annular fuel flow ring.

* * * * *